United States Patent [19]

Young et al.

[11] 4,193,818

[45] Mar. 18, 1980

[54] COMBINED ULTRASONIC CLEANING AND BIOCIDAL TREATMENT IN A SINGLE PRESSURE VESSEL

[75] Inventors: Jack H. Young, Crawford; David A. Karle; Frank E. Halleck, both of Erie, all of Pa.

[73] Assignee: American Sterilizer Company, Erie, Pa.

[21] Appl. No.: 903,249

[22] Filed: May 5, 1978

[51] Int. Cl.[2] ..... B08B 3/12

[52] U.S. Cl. ..... 134/1; 134/81; 134/21; 134/29; 134/30; 134/56 R; 134/95; 134/102; 134/184; 422/20; 422/26; 422/33; 422/128; 422/295

[58] Field of Search ..... 134/1, 18, 21, 29, 30, 134/184, 56 R, 57 R, 95, 98, 99, 102; 21/102 A, 96; 366/114, 139; 55/15; 422/20, 26, 33, 128, 295

[56] References Cited

U.S. PATENT DOCUMENTS

| | | | |
|---|---|---|---|
| 2,860,646 | 11/1958 | Zucker | 134/111 |
| 2,977,962 | 4/1961 | Zucker | 134/111 |
| 3,007,478 | 11/1961 | Leonhardt | 134/1 X |
| 3,034,520 | 5/1962 | Jewell | 134/1 X |
| 3,089,790 | 5/1963 | Balamuth et al. | 134/1 |
| 3,113,761 | 12/1963 | Platzman | 134/184 X |
| 3,198,489 | 8/1965 | Finch | 134/1 X |
| 3,254,284 | 5/1966 | Tomes | 366/114 X |
| 3,301,535 | 1/1967 | Brown | 134/184 X |
| 3,371,233 | 2/1968 | Cook | 134/184 X |
| 3,429,743 | 2/1969 | Branson | 134/1 |
| 3,433,462 | 3/1969 | Cook | 366/127 |
| 3,516,645 | 6/1970 | Arndt | 366/115 |
| 3,575,383 | 4/1971 | Coleman | 134/184 X |
| 3,633,877 | 1/1972 | Bodine | 366/113 |
| 3,638,666 | 2/1972 | Fishman | 134/1 X |
| 3,640,295 | 2/1972 | Peterson | 134/1 X |
| 3,837,805 | 9/1974 | Boucher | 422/128 |
| 3,853,500 | 12/1974 | Gassmann et al. | 55/15 |
| 3,904,392 | 9/1975 | Van Ingen | 55/15 |

FOREIGN PATENT DOCUMENTS

| | | | |
|---|---|---|---|
| 947699 | 1/1964 | United Kingdom | 422/20 |
| 947700 | 1/1964 | United Kingdom | 422/20 |

OTHER PUBLICATIONS

R. M. G. Boucher, "Advances in Sterilization Techniques," *American Journal of Hospital Pharmacy*, vol. 29, Aug. 1972, pp. 660–672.

T. J. Bulat, "Macrosonics in Industry," *Ultrasonics* Mar. 1974, pp. 59–68.

"Ultrasonic Instrument Cleaners", American Sterilizer Company Publication MC-580, Sep. 1974.

*The Journal of Hospital Research*, Research and Educational Divisions of the American Sterilizer Company, vol. 2, No. 2, Jul. 1964.

*Primary Examiner*—Richard V. Fisher

*Attorney, Agent, or Firm*—Shanley, O'Neil and Baker

[57] ABSTRACT

Method and apparatus are provided for ultrasonic cleaning and decontaminating, disinfecting, or sterilizing articles, such as surgical instruments, in a single piece of equipment. Energy transmission through a unitized shell wall coupled with deep vacuum conditions in the chamber enables rapid degasification, enhanced cavitation providing effective and efficient ultrasonic cleaning in a sealed vessel capable of carrying out high pressure sterilization.

Sonic energy transducers are rigidly mounted externally of the unitized shell to achieve desired cavitation substantially uniformly throughout the volume of the chamber established for placement of articles to be ultrasonically washed and biocidally treated.

18 Claims, 6 Drawing Figures

FIG. 2
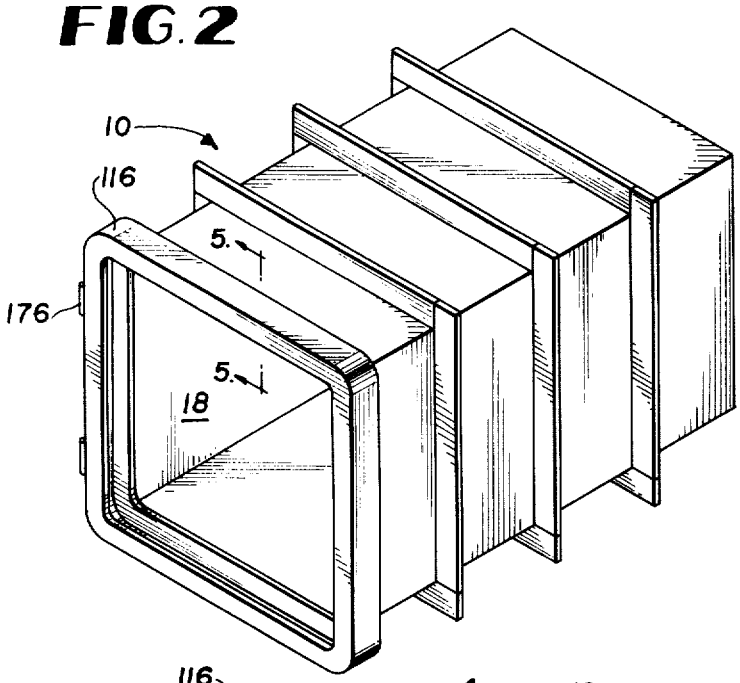
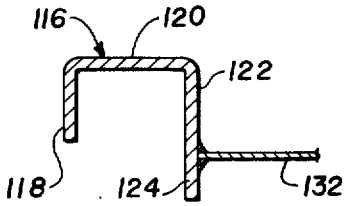
FIG. 5
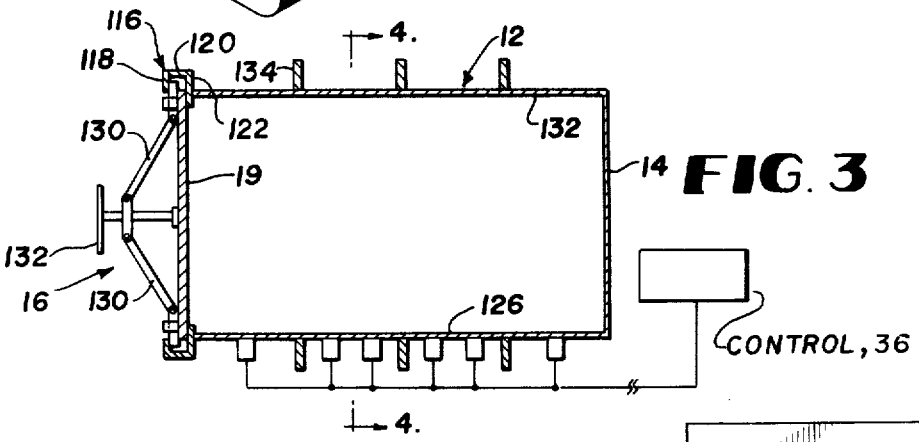
FIG. 3
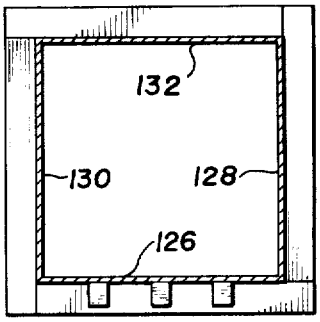
FIG. 4
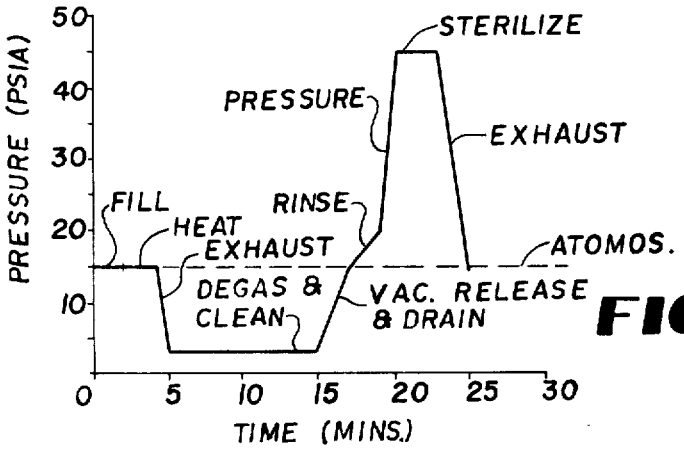
FIG. 6

COMBINED ULTRASONIC CLEANING AND BIOCIDAL TREATMENT IN A SINGLE PRESSURE VESSEL

This invention is concerned with methods and apparatus for combined ultrasonic washing and biocidal treatment of articles such as surgical instruments, utensils, and devices in a unitized shell pressure vessel.

Surgical instruments constitute a significant portion of hospital cleaning, decontamination and sterilizing requirements. The complexity of instrument design and nature of surgical soil compound the problems of surgical instrument processing. Surgical instruments usually have multiple joints, hinges, crevices or serrated edges which may harbor large amounts of soil. The soil itself is usually composed of protein or other organic material which often has been fixed in place by heat or chemicals. Furthermore, the necessity for decontamination of soiled instruments with a minimum of risk to the staff adds to the complexity of the problem.

Commercially available apparatus for preparing surgical instruments for reuse has required multiple handling steps and separate pieces of equipment. An example of a standardly practiced method of processing surgical instruments calls for placements of the instruments in a washer/sterilizer which has a cleaning phase which removes the gross soil and decontaminates the instruments with high temperature steam (normally 270° F.). Since soil which is not removed tends to be fixed in place by the steam, the instruments are then transferred to a sonic cleaner. Following sonic cleaning the instruments are terminally sterilized. This technique requires multiple handling of instruments and multiple pieces of equipment.

The present invention circumvents these problems of the prior art by making possible ultrasonic removal of all soil before subjecting the articles to biocidal treatment. Further, to accomplish the multiple processing steps of ultrasonic cleaning and decontamination, disinfection, or sterilization, only direct insertion of the articles into a single chamber is involved.

These contributions of the invention increase available options in hospital practice for handling of surgical instruments. For example, open-tray handling and processing of surgical instruments is made possible. Trays of surgical instruments can be cleaned by ultrasonic washing and sterilized directly, without leaving the surgical floor and without requiring instrument handling or muslin wrapping of instruments before resue. Or, surgical instruments directly from surgery can be cleaned by ultrasonic washing and decontaminated or disinfected for handling or storage with no hazard to personnel.

A concept, suggested in prior literature, for sonic washing in a sterilizing chamber was limited to placement of sonic transducers internally of a chamber or placement of sonic transducers on a transducer plate which was isolated by gasket mounting from the remainder of the shell. Both approaches have serious disadvantages. Internal chamber mounting of sonic transducers reduces chamber volume, requires moisture-proofing which is difficult to maintain under the harsh requirements of ultrasonic cleaning and sterilization, requires passage of electrical conductors through the vessel walls to the transducers inside the enclosure, and makes repair or replacement of transducers expensive and difficult; internal mounting of transducers in sterilizing chambers has not been commercially practical. Also, use of the separate gasket mounted transducer plate has not been accepted as commercially practical possibly because of longevity and other problems in the gasket area under the harsh conditions encountered. Therefore, hospital practice has continued to require multiple handling steps or conveyor systems utilizing multiple pieces of equipment for decontamination, sonic washing, and disinfecting or sterilizing.

Impractical and inoperative aspects of the prior art have been overcome by combining improved structural features for a unitized shell with physical steps and proper sequencing of such steps to accomplish the cavitation required for effective and efficient ultrasonic washing within a pressure vessel capable of carrying out hospital biocidal procedures.

Shell material having good sonic transmission capabilities is selected. The material is also selected to have high corrosion resistance to biocidal agents and resistance to cavitation-induced erosion and pitting; the latter requirement substantially eliminates composites such as the nickel-clad carbon steel used in many sterilizers. The shell configuration and material provide for direct, rigid, and reliable external mounting of sonic transducers. Reinforcing is selected to facilitate use of relatively thin gage metal plate for the unitized shell while maintaining strength requirements for the pressure vessel, minimizing interference with sonic energy transmission, and facilitating transducer placement for uniformity of cavitation within the chamber volume established for placement of articles.

The ultrasonic washing liquid is exposed to deep vacuum conditions in the unitized shell chamber. Combining deep vacuum and the transmitting of ultrasonic energy into the washing liquid produced a synergistic effect achieving rapid degassing of the liquid and cavitation for efficient ultrasonic cleaning. Such deep vacuum facilitates the ultrasonic cavitation which in turn facilitates rapid removal of substantially all gases. As a result, effective and efficient ultrasonic washing is made possible with the transfer of ultrasonic energy being through a unitized shell wall of a pressure vessel approved for hospital sterilizing practice.

Rapid processing of surgical instruments is a direct advantage with ultrasonic cleaning and decontamination, disinfection, or sterilization being carried out in a single chamber. Use of substantially the full volume of the chamber and economies in manufacture and maintenance result from the external surface mounting of transducers. Ultrasonic energy transmission and utilization of transmitted sonic energy are enhanced to a degree that multiple level sonic washing, e.g. permitting stacking of trays of surgical instruments in multiple tiers, is accomplished effectively and efficiently.

Because of the completeness and efficiency of the cycles available, surgical instruments can be completely processed directly after use merely by insertion into the chamber. The instruments are ultrasonically washed, rinsed, and either sterilized and readied for reuse in the same chamber or decontaminated or disinfected for transfer or storage. Structural features of the chamber and exterior mounting of the transducers provide for long life and economical operation.

Other advantages and contributions of the invention are set forth in describing a specific embodiment of the invention shown in the accompanying drawings. In these drawings:

FIG. 2 is a perspective view of rectangular cross section pressure vessel structure for carrying out the invention;

FIG. 3 is a longitudinal sectional view, in elevation, of pressure vessel apparatus of the invention;

FIG. 4 is a sectional view taken on line 4—4 of FIG. 3;

FIG. 5 is a fragmentary sectional view, on an enlarged scale, taken on line 5—5 of FIG. 2; and FIG. 6 is a graphic representation of a timepressure cycle for ultrasonic washing and sterilization of surgical instruments in accordance with the invention.

Figure 1:
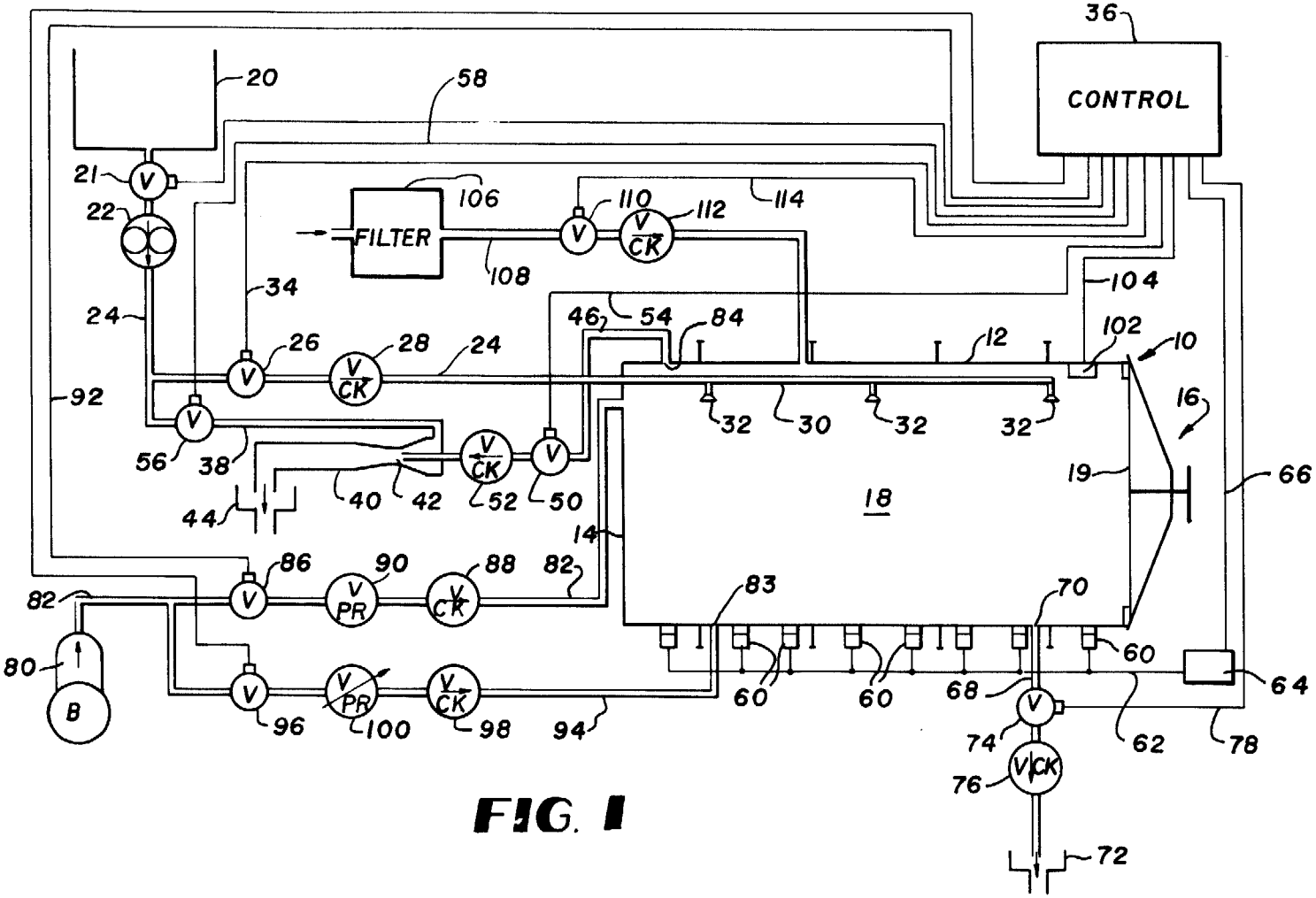
FIG. 1 is a schematic illustration of ultrasonic washing and biocidal treatment apparatus of the invention.

A pressure vessel, manufactured in accordance with teachings of the invention, is capable of operating at internal pressure levels utilized in sterilizing, i.e. 45 psig, while meeting established safety requirements.

Referring to FIG. 1, pressure vessel 10 preferably has its longitudinal axis disposed horizontally. A chamber for holding articles to be treated is partially defined by unitized shell 12 which, within the present teachings, can be relatively thin metal plate selected for transmitting desired levels of ultrasonic energy.

One longitudinal end of the unitized shell 12 can be closed by a rigidly welded end wall 14 and the other end sealed utilizing a suitable door operating assembly 16. The latter provides access to an interior washing and biocidal treatment chamber 18. Alternatively, both ends of the shell 12 can have a door to provide dual access to the interior chamber 18 when the vessel is wall mounted between rooms.

Articles to be cleaned are placed in the chamber 18; a closure-operating assembly 16 closes door 19 and seals the chamber before addition of a washing liquid. Water from a suitable source such as reservoir 20 is delivered, through solenoid-actuated control valve 21, by pump 22 into the chamber 18 via a suitable conduit 24. Detergent may be injected into the water delivered to the chamber by suitable means, not shown. An electrically operated flow control valve 26 and one-way check valve 28 are provided in conduit 24 between pump 22 and the chamber 18.

Conduit 24 is connected through a wall of the pressure vessel to a spray bar 30 having a plurality of spray heads 32 which direct the washing liquid in a spray encompassing substantially the entire interior of the chamber 18 established for placement of articles by racks or shelves (not shown). When two or more racks of instruments are to be supported one above the other in the chamber, spray heads 32 may also be positioned to direct spray inwardly. The flow control valve 26 can be a solenoid-actuated, normally-closed, energized-open valve connected, through conductor 34, to a master control 36.

Washing liquid admitted to chamber 18 normally contains substantial quantities of dissolved and entrained gas which inhibits cavitation. It has been found that a relatively deep vacuum, combined with the ultrasonic energy which can be transmitted through the unitized shell 12, makes possible both effective and efficient cleaning of surgical instruments.

The invention provides for rapidly removing substantially all gas from the washing liquid. The admission of washing liquid into the chamber 18 is controlled to a predetermined depth, sufficient to cover articles to be cleaned. A void space can be left in the chamber above the surface of the liquid or a standpipe communicating with the chamber can be provided to expose the washing liquid to the deep vacuum taught. The chamber can thus be rapidly evacuated to a relatively deep vacuum which, together with the ultrasonic energy, rapidly removes gas from the liquid.

Desired evacuation of the chamber can be accomplished in an economically practical manner by a water ejector apparatus. Referring to FIG. 1, this apparatus includes a supply pipe 38 connected, through conduit 24, to the outlet of pump 22, and to an ejector assembly 40 having a reduced diameter venturi section 42. Outlet from the ejector 40 discharges through a suitable sump or drain 44. A second pipe 46 has one end connected to an outlet opening 48 in the upper portion of the chamber 18 and its other end terminating in the throat 42 of the ejector 40.

An electrically actuated control valve 50 and a one-way check valve 52 connected in line 46 control the flow of air and gases from the void in the top of chamber 18 to the ejector 40. Valve 50 is connected, through conductor 54, to the main control 36 which actuates the valve to control the flow of gas through pipe 46.

An electrically actuated valve 56 in water supply line 38 is connected to and actuated by control 36, via line 58; this controls the supply of water to the ejector 40. Thus, opening of valves 50 and 56 will result in gas being drawn from chamber 18 by an aspiration effect to rapidly reduce the pressure above the washing liquid to a deep vacuum.

Evacuation can commence simultaneously with the admission of water into the chamber and continue for a sufficient time to achieve the desired vacuum level after the filling operation has been completed. Alternatively, the evacuation can commence after the filling operation is partially or completely accomplished. It has been found that an optimum level of cavitation, with a resulting increase in cleaning efficiency, is achieved by maintaining substantially the desired deep vacuum exposure of the liquid during ultrasonic treatment.

In order to transmit desired ultrasonic energy, a plurality of ultrasonic transducers 60 are rigidly mounted on an external surface of unitized shell 12. The transducers 60 are connected, through a conductor harness 62, to a power source 64. The latter, in turn, is connected through line 66 to control 36 for driving the transducers. Transducers 60 are arranged in a pattern on the vessel shell to apply ultrasonic energy throughout the liquid in chamber 18 providing substantially uniform cavitation while minimizing wave energy cancellation. The energy level and pattern assure cavitation throughout the liquid to make possible uniform cleaning of articles, such as surgical instruments, supported in trays submerged at multiple levels in the cleaning liquid.

Established cleaning tests have been used to verify the effectiveness of ultrasonic cleaning with the present invention. However, the level of cavitation achieved provides a faster quantitative indication of cleaning effectiveness and efficiency. Cavitation can be evaluated quantitatively by known methods, e.g. utilizing an iodine release test which measures iodine liberation from potassium iodide in the presence of carbon tetrachloride. The relationship between iodine release and vacuum level, when combined with ultrasonic energy transmission as taught, is exponential; for apparatus of the type under consideration this relationship can be expressed:

$$I = 1.3 \times 10^{.53V}$$

where I equals iodine release in mg/liter and V equals vacuum level in inches of mercury.

Ultrasonic energy transmission combined with vacuum levels in excess of approximately 15" Hg. is effective in producing functional cavitation. Vacuum levels of about 20" Hg. and higher up to about 30" Hg. are preferred; e.g. pulling a vacuum of about 25" Hg. significantly multiplies (by a factor of about 10) the iodine release over that available without a vacuum. Maintaining a high vacuum throughout application of ultrasonic energy further multiplies cleaning effectiveness as indicated by the iodine release available.

Formal data on the utilization of iodine release as an indicator of effective and efficient ultrasonic washing of surgical instruments is not available in the literature; however, it has been verified through established cleaning tests that an iodine release of about twenty (20) to about thirty (30) mg/l indicates a cavitation level providing effective cleaning, within commercially acceptable time periods, of dual tier stacks of surgical instrument trays. Also, that iodine release in excess of thirty (30) mg/l, which is readily available with the present invention, indicates a cavitation level providing for effective and efficient cleaning of three tier stacks of surgical instrument trays within a sterilizing chamber.

Iodine release values in the above range are readily achieved in a 16"×16"×26" vessel utilizing 25" Hg. vacuum and between twenty-four and thirty-six transducers, operating at a frequency between forty and forty-five Khz, with total power input in the range of 1000 to 1500 watts. Iodine release levels approaching 60 mg/l are available in such a chamber with the present invention by utilizing forty-eight transducers. These values are accomplished while maintaining noise level readings, at multiple locations within 6" to 5' of the ultrasonic washer-sterilizer, below those permitted by Federal regulations (OSHA) for continuous operation without ear protection.

Upon completion of the deep vacuum, ultrasonic degassing, cavitation, and cleaning, the washing liquid is drained from chamber 18 through a drain pipe 68 connected to a drain outlet 70 in the bottom of the unitized shell. Flow through the drain pipe 68 to drain 72 is controlled by a suitable electrically operated valve 74 and a one-way check valve 76. Actuation of valve 74 is controlled by the main control 36 through conductor 78.

In order to drain liquid from the chamber 18 however, it is necessary to first release the vacuum in the void above the liquid. This can be accomplished by admitting gas, such as steam or air, into the chamber in sufficient quantities to break the vacuum. In the embodiment illustrated, steam can be supplied from a suitable source such as a boiler 80 through a pipe 82. Multiple inlets can be provided with inlet 83 in the lower portion of the chamber or inlet 84 in the top portion.

When steam is utilized to break the vacuum, an electrically actuated flow control valve 86 and a one-way check valve 88 control the flow of steam from boiler 80 to the chamber 18. A pressure regulator 90 can be connected in line 82 to control the steam pressure admitted into the chamber. Actuation of valve 86 is controlled by main control 36 through line 92. Upon completion of the ultrasonic washing, valve 86 can be opened to admit a controlled flow of steam into chamber 18 to break the vacuum and, if desired, to build up a positive pressure to assist in forcing the washing liquid from the chamber 18.

As an alternative, air at atmospheric pressure may be employed to break the vacuum. Air, which may be filtered by a suitable bacterial filter 106, passes into chamber 18 through conduit 108 having an electrically actuated control valve 110 and a one-way check valve 112 connected therein. Valve 110 is controlled by main control through line 114.

When washing liquid is removed from the chamber, soil materials which have been dislodged from the articles may be redeposited. Provision should be made for removal of redeposited material before biocidal treatment. As the washing liquid is drained to a level exposing the washed articles, valve 26 can be opened while drain valve 74 is maintained open to provide for flow of rinsing liquid from the spray nozzles 32 over the articles within the chamber to remove dislodged soil directly to drain. Additional nozzles can be positioned internally of the chamber for spraying from different directions as may be required for adequate removal in multiple tier operation.

Upon completion of the rinsing operation, valves 26 and 74 are closed and the biocidal treatment phase is started. In a steam sterilizing treatment, steam supply pipe 94 is connected in pipe 82 upstream of valves 86, 88 and the pressure regulator 90. An electrically actuated flow control valve 96 and a one-way check valve 98 are connected in pipe 94 to control the flow of steam through this line to the chamber 18 either through inlet 83 or, if desired, through inlet 84 in an upper portion of the chamber. A pressure regulator 100 is connected in the pipe 94 and set at a pressure to provide the desired steam sterilization temperature, generally between about 250° F. and 285° F. at pressures in a range of about 15 to about 45 psig; at 270° F. an internal steam pressure of about 30 psig is provided. Control 36 maintains valve 96 in the open position, with pressure regulator 100 controlling the pressure within the chamber for a sufficient time to complete the sterilizing operation.

Alternatively, a temperature, pressure, or combination temperature-pressure sensor, indicated generally at 102, can be located within the chamber and connected, through conductor 104, to main control 36 to continuously monitor the actual pressure and/or temperature within the chamber, with the signal from sensor 102 being employed by main control 36 to control the flow of steam through valve 96 into the chamber.

An advantage of vacuum capability is that, at the conclusion of steam sterilization, a vacuum can be applied to remove steam and dry the instruments before opening of the chamber; the instruments will then be ready for use. Alternatively, valve 96 can be closed and the drain valve 74 opened to permit the pressure within the chamber to return to ambient. A holding tank can be substituted for drain 72 if ETO or other chemical biocidal agents are used. With venting of the sterilizing fluid from the chamber, air can be admitted into the chamber 18. When sterilized instruments are to be left in the chamber for substantial times, for example until they are again required for a surgical procedure, or when it is desired to flow air through the chamber to flush residual sterilizing gas from the chamber, filtered air can be supplied to the chamber at the end of the sterilizing procedure. To this end, the filter 106, having a filter element sufficiently fine to remove essentially all bacteria from air passing therethrough, may be utilized to assure against contamination of the instruments in the chamber. Inlet to the filter 106 may be through an opening to atmosphere or, alternatively, a suitable source of air pressure may be provided if it is desired to circulate air through chamber 18 at the conclusion of the washing and sterilizing operation.

Data presented on the 16"×16"×26" chamber relates to a shell 12 constructed of 3/16" stainless steel plate. Stainless steel, type 316L, is a representative metal having desired strength, ultrasonic transmission capabilities, and desired corrosion resistance. Low carbon content in the metal facilitates transmission of ultrasonic energy; other characteristics which facilitate transfer of ultrasonic energy are known so as to enable selection of shell material by those skilled in the art.

For a rectangular cross section sterilizer, the metal plate is rigidly welded at longitudinal corners of the shell to form a completely unitized chamber body. End wall 14 can be constructed of the same stainless steel material and can, preferably, be of slightly heavier gage to add reinforcing strength. End wall 14 is rigidly welded to one longitudinal end of the plate making up the unitized body. The opposite end of the unitized shell 12 is welded around its periphery to a conventional end ring which reinforces the open end of the shell and provides for mounting of door assembly 16.

Referring to FIG. 5, end ring 116 is in the form of an inwardly open channel having outer and inner, inwardly directed flanges 118, 120, respectively, integrally formed with an axially extending web portion 122. The inner flange 120 is rigidly welded to the end of the unitized shell 12 and projects inwardly a distance substantially greater than flange 118, with the outwardly directed surface 124 forming a sealing surface. Closure operating assembly 16 can be of conventional construction and can be mounted by hinges 176 on one side of the end ring 116. The door 19 (FIG. 3) comprises a rigid flat closure plate dimensioned to overlie the sealing surface 124 of the flange 122 around its entire periphery to seal the chamber 18. A suitable sealing gasket, not shown, can be carried on the door surface to assure a good seal.

Locking arms 136 can be extended by an actuating lever mechanism 138 to project into the inwardly directed open channel of the end ring (FIG. 3).

In the embodiment illustrated in FIGS. 2-5, the unitized shell 12 presents, in vertical cross section, a flat bottom plate 126 with parallel vertical side plates 128, 130 and a horizontal top plate 132. This rectangular cross-sectional configuration provides maximum usable space within the chamber 18 and conventional rack support structure can be provided. An external surface is provided as part of the unitized shell concept to facilitate reliable mounting of transducers; bracing is preferred with an alloy capable of withstanding the temperature gradient. Generally a substantially flat external surface is provided for ease of mounting. Other cross-sectional configurations for the chamber and external surface can be used, e.g. curvilinear, if provisions are made for securing the transducers and for avoiding undue interference or cancellation of wave energy within the chamber.

A plurality of transducers 60 are arranged in a selected pattern over substantially the entire bottom wall and/or on the side walls of the shell to facilitate uniform distribution of ultrasonic energy throughout the volume of washing liquid established for placement of articles and to eliminate or minimize sonic wave interference. If transducers are mounted on multiple walls, sequential energization of the transducers can be utilized to avoid or minimize sonic wave interference within the chamber.

In the specific embodiment of the invention shown, the bottom wall 126, the side walls 128, 130 and the top wall 132 have been constructed from 3/16" gage 316L stainless steel. Chamber 18 is 16"×16" in cross section with a longitudinal dimension of 26". Reinforcing ribs were placed at spaced intervals along the length of the chamber to enable the chamber to withstand internal pressures for steam sterilizing and vacuums approaching 30" Hg., with safety factors as required by A.S.M.E. specifications.

As shown in FIGS. 2-4, the unitized shell 12 is reinforced by a plurality of steel bars 134 rigidly welded to the external surface of the shell 12. The reinforcing bars 134 at each position are arranged and welded together to form a complete ring 135 circumscribing the shell. Four reinforcing rings are employed in this embodiment with the spacing between adjacent circumscribing rings 135 and between the respective ends of the chamber and the adjacent ring 135 being substantially equal. A total of thirty-six ultrasonic transducers rigidly mounted on the external surface of the bottom wall 126, operating at forty-one Khz and total power input of approximately 1500 watts, was found to be adequate to provide the necessary cavitation for effective and efficient cleaning. The transducers were arranged in a uniform pattern including a plurality of transducers between each adjacent pair of reinforcing rings 135, and between the end rings and the respective ends of the unitized shell.

In FIG. 6, a commercially practical cycle of operation of a sonic washer-steam sterilizer is schematically presented in terms of chamber pressure vs. time. A void space is preferably left in the chamber above the surface of the liquid at the completion of the filling operation; filling may require about two minutes for a 16"×16"×26" washer-sterilizer chamber. An added advantage of the combination washer-sterilizer of the present invention is that steam from the sterilizing process can be used directly for heating the washing liquid within the chamber. The steam is discharged beneath the surface of the washing liquid for a time sufficient to heat the washing liquid to the desired temperature; about 80° F. to about 120° F. is utilized for protein matter soil. Alternative heating means such as submersible electric resistance heaters may be employed. Heating of the washing liquid helps in providing rapid degassing as does the use of a detergent which reduces surface tension.

The pressure in chamber 18 may remain substantially at atmospheric, or increase slightly during the filling operation and during the heating of the water. Heating of the washing liquid with steam may require another two minutes of cycle time.

Upon completion of the in-chamber heating, the water ejector apparatus is actuated to evacuate the void in the chamber 18 to the desired deep vacuum. The synergistic action of the deep vacuum and the ultrasonic energy are required to achieve both the degassing and the cavitation taught by the present invention within acceptable times for use in hospital sterilization and other institutional biocidal treatment. Neither the deep vacuum nor the ultrasonics alone will suffice. When the desired vacuum level is reached in the chamber, control 36 energizes the power source 64 to drive the ultrasonic transducers 60 to apply ultrasonic energy to the washing liquid through the bottom wall 126 of the unitized shell 12 and effect desired degassing, cavitation, and cleaning. Sensor 102 may be employed to signal the desired vacuum level or, alternatively, the evacuator may be operated for a predetermined time which has been empirically determined to be sufficient to attain the desired vacuum level.

The ultrasonic energy transmitted in cooperation with the deep vacuum established acts quickly to substantially completely degas the liquid with cavitation at a level not otherwise available. The combined effect produces a profuse removal of gas and agitation within the solution caused by such profuse removal; both aid in the cleaning and both are readily apparent if the apparatus is viewed through an observation glass in the door.

As one aspect of a preferred cycle, operation of evacuating apparatus 40 is continued for at least a portion of the time during which ultrasonic energy is applied to the washing liquid to continue withdrawal of gas liberated from the liquid and to assure that the desired vacuum level is maintained until degassing is complete. The vacuum level can be maintained thereafter by closing the valve 50. Alternatively, the evacuator can be operated continuously throughout the ultrasonic cleaning phase of the cycle.

In the preferred sequence, evacuation to the deep vacuum level takes place prior to application of utltrasonic energy; i.e. ultrasonic energy transmission is not initiated until the desired deep vacuum level is reached, or approximated. Tests show that this sequence produces better cavitation and more efficient cleaning than initiation of sonic energy significantly above the desired deep vacuum level. Utilizing forty-eight transducers at a total power input of 2000 watts at forty-one Khz after drawing a vacuum of at least 25" Hg. resulted in an iodine release of 57 mg/l; thus indicating extremely efficient degassing and a high level of cavitation. With the deep vacuum established, the liquid media is "shocked" by the ultrasonic energy; gas bubbles are violently released producing a visible foaming action which travels to the surface. This contrasts with the results achieved when ultrasonics are applied prior to reaching deep vacuum. In the latter sequence, a large number of gas bubbles attach to the walls and bottom of the chamber; while iodine release under this latter condition indicates adequate cavitation, being approximately 25 mg/l, the preferred sequence optimizes the cavitation as indicated by the iodine release test results.

As shown in FIG. 6, ultrasonic cleaning can be completed within about fifteen minutes from the start of the filling operation; such a time period is within desired commercial efficiency. Upon completion of the ultrasonic cleaning phase of the cycle, main control 36 acts to deenergize the ultrasonic transducers and to close valves 50 and 56 if these valves have not been previously closed. Control 36 then admits either steam or air into the chamber for a time to release the vacuum in the chamber. Drain valve 74 is then opened to permit the washing liquid to drain from the chamber. Approximately two minutes can be required to break the vacuum and drain a chamber of the size described.

As washing liquid is drained from chamber 15, control 36 opens the valve 26 to spray liquid downwardly from nozzles 32 to rinse the cleaned articles and remove any dislodged particles which may have been floating on the surface of the washing liquid and settled on the articles during draining. During this rinsing operation, drain valve 74 remains open. About two minutes is sufficient time for the removal of loose debris; at the conclusion, rinse water supply valve 26 and drain valve 74 are closed.

Steam valve 96 is then opened to admit live steam to increase the pressure in chamber 18 to, e.g., approximately 30 psig to produce a temperature of approximately 270° F. The temperature is maintained at this sterilizing level for a time sufficient to completely sterilize the articles, generally in the range of three to five minutes. Lower pressures can be used for other biocidal treatments.

A preferred cycle of operation according to the present invention may thus involve loading articles to be treated into the chamber and sealing the chamber, admitting ultrasonic washing liquid and detergent into the chamber to a level covering the articles to be cleaned, injecting steam into the washing liquid to heat the liquid, evacuating the chamber to expose the washing liquid to a deep vacuum in excess of about 15" Hg. and preferably about 20" Hg. to about 30" Hg., transmitting ultrasonic energy through the unitized shell of the chamber while maintaing the deep vacuum during at least a portion of the time of application of ultrasonic energy to degas the washing liquid and to ultrasonically clean the articles in the chamber, releasing the vacuum in the chamber, draining the washing liquid from the chamber, spraying rinsing liquid into the chamber to remove redeposited soil material from the articles, purging the chamber with steam, sterilizing the articles in the chamber with steam at a pressure in the range of about 15 to 45 psig., and exhausting the steam and applying vacuum to the chamber to remove steam from the chamber and dry sterilize articles, the steps of admitting washing liquid and detergent into the chamber, evacuating the chamber, and applying ultrasonic energy to the chamber to complete degassing and ultrasonic cleaning being accomplished in a predetermined time and not substantially in excess of about fifteen (15) minutes, and the complete process from commencement of admission of the washing liquid and detergent into the chamber to completion of exhaust of steam being carried out in about thirty (30) minutes.

At the conclusion of biocidal treatment, drain valve 74 is opened to permit the pressure in the chamber to return to atmospheric. The vessel may then be opened to remove the articles from the chamber 18; however, if desired, the chamber 18 may remain sealed to further assure the sterile condition of the articles until next needed. If the articles are to remain in the chamber 18, valve 110 should be open to permit filtered air to maintain the pressure at substantially atmospheric level as the chamber cools.

It should be understood that various configurations and sizes can be employed for the pressure vessel by utilizing the above teachings of the invention on transfer of the sonic energy and use of deep vacuum levels to obtain desired cavitation within a unitized shell meeting necessary pressure vessel strength requirements. Also, in the light of these teachings, method step modifications can be made which fall within the principles of the invention. Therefore, the scope of the invention should be determined by reference to the appended claims.

We claim:

1. Method for combined ultrasonic washing and biocidal treatment of articles, such as surgical instruments, comprising providing a sealable chamber capable of operating at pressures other than atmospheric including both positive pressures and vacuum levels in excess of 15" Hg. and defined by a unitized shell main body portion, placing an article to be ultrasonically cleaned and biocidally treated in such chamber and sealing the chamber, admitting an ultrasonic washing liquid into the shell chamber, controlling such washing liquid admission to cover the article to be cleaned, evacuating the chamber to expose the washing liquid to a deep vacuum in excess of about 15" Hg., transmitting ultrasonic energy through such unitized shell while maintaining such deep vacuum during at least a portion of the time that ultrasonic energy is transmitted into the washing liquid, such ultrasonic energy being transmitted by energizing a plurality of transducers secured to such unitized shell externally of such chamber to achieve desired degassing of and cavitation in such washing liquid to ultrasonically clean the article, releasing the vacuum in the chamber, draining the washing liquid from the chamber, and admitting a biocidal fluid into the chamber to provide desired biocidal treatment of such article.

2. The method of claim 1 wherein the step of evacuating the chamber comprises evacuating to a vacuum level in the range of about 20" Hg. to about 30" Hg.

3. The method of claim 1 in which such transmitting of ultrasonic energy is initiated after establishing substantially the desired deep vacuum.

4. The method of claim 1 in which evacuation is initiated as washing liquid is being added.

5. The method of claim 1 including continuing evacuating during at least a portion of the time that ultrasonic energy is being transmitted.

6. The method of claim 1 including maintaining the biocidal fluid in the chamber for a time sufficient to sterilize the article in the chamber.

7. The method of claim 1 in which the step of admitting a biocidal fluid comprises admitting a biocidal gas.

8. The method of claim 7 further comprising the step, after drainage of washing liquid, of removing any redeposited material from the article before biocidal treatment.

9. The method of claim 7 in which the step of admitting a biocidal gas comprises admitting steam.

10. The method of claim 9 including the step of, evacuating the chamber after biocidal treatment to remove steam and dry such article before opening such sealed chamber.

11. The method of claim 9 further comprising the step of, heating the washing liquid to a temperature in the range of about 80° F. to about 120° F. by injecting live steam into the washing liquid in the chamber.

12. The method of claim 1 including the step of injecting a detergent into the washing liquid prior to injecting the live steam to heat the washing liquid.

13. The method of claim 1 wherein the step of admitting biocidal fluid into the chamber comprises pressurizing the chamber with live steam to a pressure in the range of about 15 to 45 psig and maintaining substantially such steam pressure for a desired exposure time to effect sterilization.

14. The method of claim 1 comprising evacuating the chamber to a vacuum level of approximately 25" Hg. before commencing the application of the ultrasonic energy and maintaining substantially that vacuum level while applying ultrasonic energy to the washing liquid to substantially complete such degassing, cavitation and ultrasonic cleaning in a predetermined time not substantially in excess of about fifteen (15) minutes in which the total ultrasonic washing and treating cycle includes washing liquid admission, detergent injection, heating of the washing liquid, vacuum draw-down to about 25" Hg., transmitting ultrasonic energy into the washing liquid, releasing vacuum in the chamber, draining washing liquid, rinsing any redeposited soil materials, purging the chamber with steam, sterilizing the article with steam at a pressure in the range of about 15 to about 45 psig., exhausting the steam and applying a vacuum to remove steam from the chamber and dry the sterilized article, and in which such total cycle is carried out in about thirty (30) minutes.

15. The method of claim 1 in which the steps of admitting an ultrasonic washing liquid, evacuating the chamber to a vacuum level in excess of about 15" Hg., and transmitting ultrasonic energy into the washing liquid while maintaining such vacuum level during at least a portion of the time that ultrasonic energy is being transmitted to degas such liquid and produce desired cavitation to ultrasonically clean the article is completed in about fifteen (15) minutes.

16. Apparatus for combined ultrasonic washing and biocidal treatment of articles such as surgical instruments comprising a sealable chamber for receiving articles to be ultrasonically cleaned and biocidally treated therein, the chamber being capable of operating at pressures other than atmospheric including vacuum levels in excess of about 15" Hg. and defined by a unitized shell main body portion, means for sealing the chamber, means for admitting an ultrasonic washing liquid into such sealed chamber, means for controlling such washing liquid admission to cover the articles to be cleaned, means for exposing the washing liquid to a deep vacuum, a plurality of transducers secured to such unitized shell externally of such chamber to transmit ultrasonic energy into the washing liquid to achieve desired degassing of and cavitation in such washing liquid to ultrasonically clean the articles by exposure to the cavitation, means for releasing the vacuum in the chamber, means for draining the washing liquid from the chamber, means for admitting a biocidal fluid into the chamber to provide desired biocidal treatment of such articles, and control means for controlling sequence of operation of the evacuating means, the plurality of ultrasonic transducers, and the means for releasing vacuum such that the deep vacuum is maintained during at least a portion of the time that ultrasonic energy is transmitted into the washing liquid.

17. Structure for ultrasonic washing and biocidal treatment of articles such as surgical instruments in a chamber capable of operating at vacuum levels in excess of 15" Hg. comprising, a unitized shell made from corrosion resistant metal plate of relatively thin gage not substantially in excess of 3/16" to provide for desired transmission of sonic energy, such unitized shell establishing a main body portion partially defining a chamber for holding articles to be ultrasonically washed and biocidally treated, such chamber being further defined by end walls for such unitized shell, such end walls including a chamber access door for placement of articles in the chamber and sealing of the chamber, the unitized shell presenting a transducer receiving external surface extending between such end walls over a dimension correlated with that established for placement of articles within the chamber, a plurality of sonic transducers rigidly mounted externally of the chamber on such external surface of the unitized shell, such plurality of transducers being distributed on such external surface between such end walls to provide substantially uniform sonic energy distribution throughout the sonic cleaning liquid in that portion of the chamber established for placement of articles, means for introducing sonic cleaning liquid to a selected depth within such chamber, evacuating means for establishing a vacuum level in excess of 15" Hg. within the chamber, means for energizing such sonic transducers while maintaining approximately such vacuum within the chamber, means for draining sonic cleaning liquid from the chamber, and means for introducing biocidal fluid into the chamber and carrying out biocidal treatment of articles placed in the chamber.

18. Apparatus for ultrasonic cleaning and subsequently biocidally treating articles such as surgical instruments in a sealable chamber capable of operating at pressures other than atmospheric, the apparatus comprising, a chamber defined by a unitized main body shell and closure means, the unitized main body shell having a horizontal axis, and including a substantially flat bottom wall, opposed upwardly extending sidewalls and a top wall rigidly welded together at their longitudinal edges, the endwall means closing longitudinal ends of such unitized shell wth at least one door means openable to provide access to the chamber and closable to seal the chamber, shell strengthening means including a plurality of reinforcing ribs positioned externally of and rigidly integral with the unitized body chamber, such ribs circumscribing such unitized chamber body and being substantially uniformly spaced along such horizontal axis, evacuating means connected in fluid communication with an upper portion of the chamber and operable to evacuate the chamber to vacuum levels in excess of about 15" Hg., fluid inlet means for supplying cleaning liquid to the chamber, a plurality of ultrasonic transducers rigidly integral with the external surface of at least one wall of the unitized chamber body and distributed to provide substantially uniform sonic energy throughout the cleaning liquid in that portion of the chamber established for placement of articles, power means connected to the transducers for driving the transducers to apply ultrasonic energy to a cleaning liquid in the chamber directly through at least one wall of the unitized chamber body, fluid removal means including drain means for removing the cleaning liquid from the chamber, biocidal fluid inlet means for admitting a sterilizing fluid into the chamber, valve means connected in the cleaning fluid inlet means, the biocidal fluid inlet means, and the fluid removal means to control fluid flow, and control means operatively connected with and controlling operation of the valve means and the power means connected to the transducers to: (a) admit a predetermined amount of cleaning liquid into the chamber; (b) operate the evacuating means to evacuate the chamber to establish a vacuum in excess of about 15" Hg.; (c) energize the transducers while the chamber is under such vacuum to transmit ultrasonic energy to the liquid in the chamber through at least one wall of the chamber for a time sufficient to degas and obtain desired cavitation in such cleaning liquid; (d) drain the cleaning liquid from the chamber; (e) admit sterilizing fluid into the chamber; and (f) remove the sterilizing fluid from the chamber.

* * * * *